US005586655A

United States Patent [19]

McBride

[11] Patent Number: 5,586,655

[45] **Date of Patent: *Dec. 24, 1996**

[54] LINE STORAGE DEVICE

[75] Inventor: John C. McBride, Athens, Ala.

[73] Assignee: Bag-It Products Corp., Nashville, Tenn.

[ * ] Notice: The portion of the term of this patent subsequent to Dec. 28, 2013, has been disclaimed.

[21] Appl. No.: 469,487

[22] Filed: Jun. 6, 1995

Related U.S. Application Data

[63] Continuation of Ser. No. 174,045, Dec. 28, 1993, Pat. No. 5,439,109.

[51] Int. Cl.[6] ..... B65D 85/00

[52] U.S. Cl. ..... 206/388; 383/121.1; 383/111; 174/135

[58] Field of Search ..... 206/328, 388, 206/408; 383/38, 40, 120, 121.1, 111; 174/135

[56] References Cited

U.S. PATENT DOCUMENTS

| | | |
|---|---|---|
| 1,148,924 | 8/1915 | Paradise . |
| 2,292,140 | 8/1942 | Lofgren . |
| 2,377,311 | 6/1945 | Campbell . |
| 2,530,746 | 11/1950 | Wetherby . |
| 2,707,010 | 4/1955 | Armistead . |
| 2,739,410 | 3/1956 | Budnick . |
| 2,741,009 | 4/1956 | Slayter et al. . |
| 2,913,740 | 11/1959 | Eldridge . |
| 3,058,507 | 10/1962 | Patterson, Jr. . |
| 3,061,088 | 10/1962 | Buddecke . |
| 3,089,210 | 5/1963 | Ritter . |
| 3,324,917 | 6/1967 | Schirtzinger . |
| 3,520,988 | 7/1970 | Ballock, Sr. . |
| 4,004,625 | 1/1977 | Zietlow, Jr. . |
| 4,008,806 | 2/1977 | de Páez et al. . |
| 4,022,323 | 5/1977 | Yamazaki . |
| 4,593,815 | 6/1986 | Wright . |
| 4,662,517 | 5/1987 | Wirth . |
| 4,688,674 | 8/1987 | Stirtz . |
| 4,875,878 | 10/1989 | Meyer . |
| 4,897,982 | 2/1990 | Day et al. . |
| 4,979,614 | 12/1990 | Ruhaut . |
| 4,984,685 | 1/1991 | Douglas . |
| 5,103,977 | 4/1992 | Douglas . |
| 5,121,776 | 6/1992 | Kovach . |
| 5,439,109 | 8/1995 | McBride ..... 206/388 |

FOREIGN PATENT DOCUMENTS

| | | |
|---|---|---|
| 189126 | 2/1937 | Switzerland . |

*Primary Examiner*—Marie D. Patterson
*Attorney, Agent, or Firm*—Harness, Dickey & Pierce, P.L.C.

[57] ABSTRACT

A light-weight, portable, container which facilitates the storage and retrieval of flexible, elongated elements, such as line, cord, rope, hose, wire and the like is disclosed. The line storage device incorporates a base portion which enables the device to stay in a stationary position while in use. Extending from the base portion is a conically-tapered, flexible, body portion that terminates in a closeable aperture. The aperture provides an opening into the interior of the line storage device through which a first end of the line or other elongated element is passed as it is stored or retrieved. The line is linearly fed or "stuffed" into the device by the operator through a "bottle-neck" that is created by grasping the body portion near the opening of the container. As the line enters the container through the bottle-neck, it is effectively wiped clean and dry. Once past the bottle-neck, the line is free to fall randomly, subject to the linear feeding action, the force of gravity and the confines of the container. A section of the line can be withdrawn from the line storage device by the operator as desired. Further, the line storage device of the present invention is reducible to a compact configuration for storage purposes by collapsing the flexible body portion and folding it into the base portion. In this position, several of the devices can be stacked upon one another.

16 Claims, 3 Drawing Sheets

FIG 1
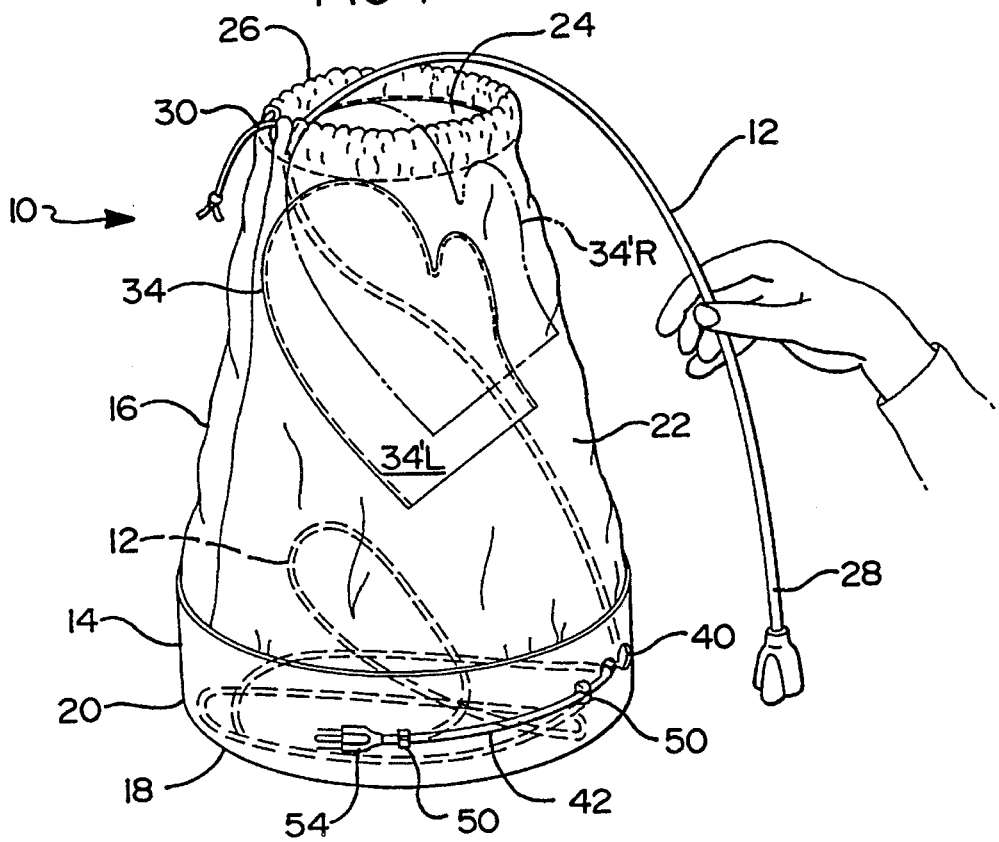
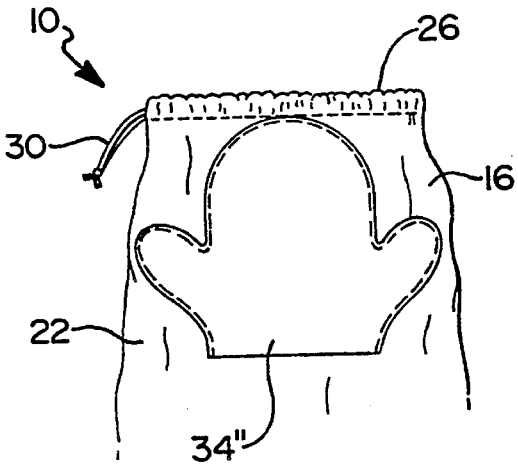
FIG 3
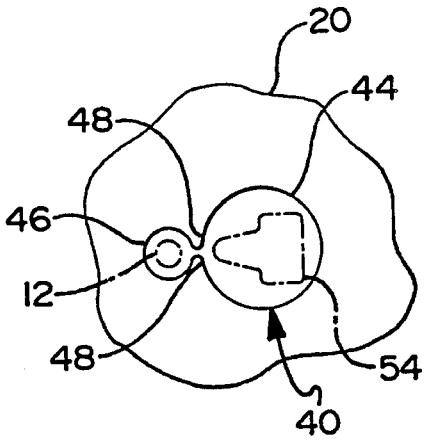
FIG 5

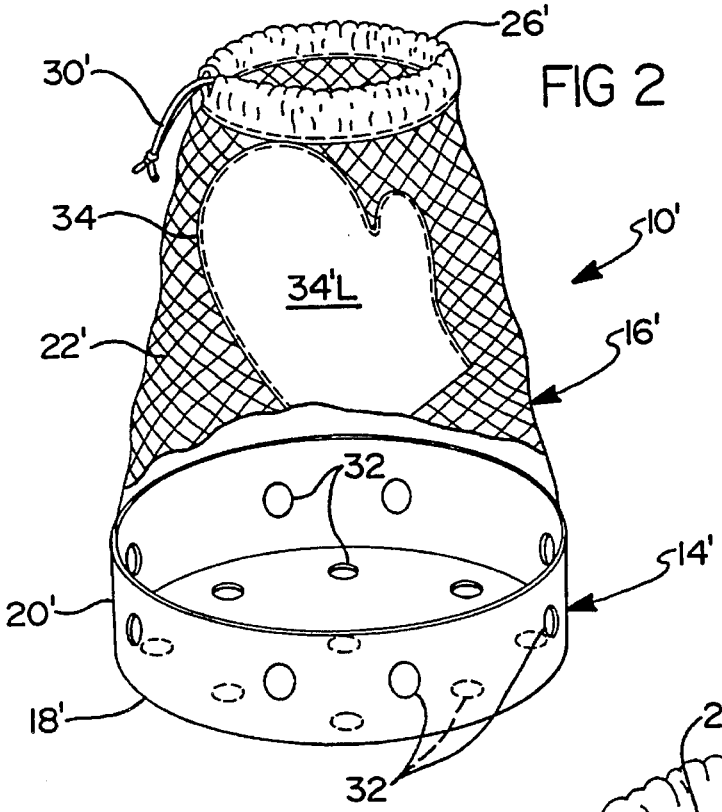
FIG 2
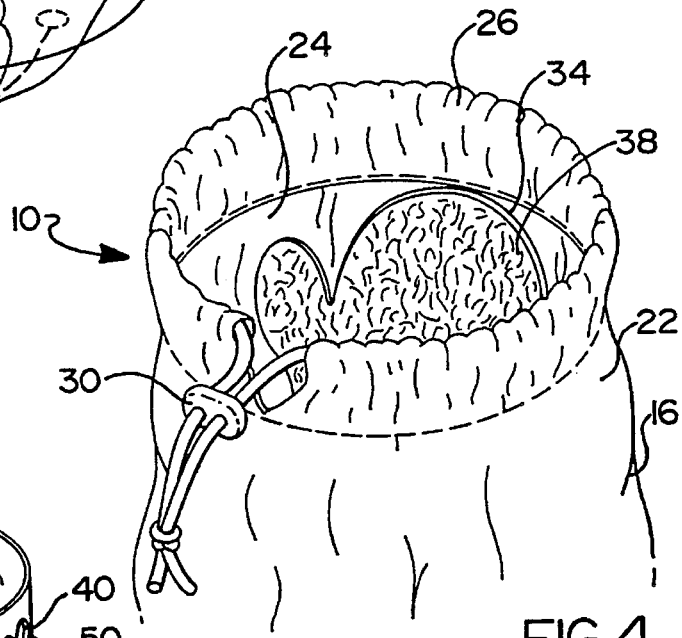
FIG 4
FIG 6
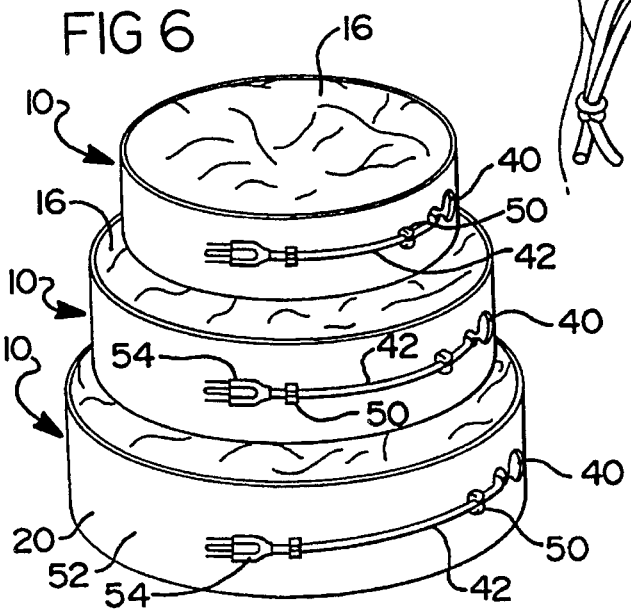

LINE STORAGE DEVICE

This is a continuation of U.S. patent application Ser. No. 08/174,045, filed Dec. 28, 1993, now U.S. Pat. No. 5,439,109.

BACKGROUND OF THE INVENTION

1. Field of the Invention

The present invention relates to a device which facilitates the storage and retrieval of flexible, elongated elements and, more particularly, to a light-weight, portable, container for storing line or other elongated articles such as cord, rope, hose, wire, and the like, from which the line may be easily retrieved.

2. Discussion

A common problem typically encountered when dealing with the repeated storage and retrieval of elongated, flexible elements, including items such as line, cord, rope, hose and wire, is entanglement. Entanglement often is a nuisance and frustration to skilled workmen, homeowners and boat owners, among others. Consequently, the development of numerous methods and apparatus for line storage and retrieval have been motivated by the desire to address and alleviate this well-known problem. Most obvious, the simple method of manually looping or winding the line into a coil, either with or without the assistance of a form member, such as a spindle, has been employed. However, this practice is usually tedious and time-consuming.

One type of apparatus that is often used for line storage and retrieval employs a conventional spindle-and-reel arrangement. When needed for use, the line is pulled or otherwise removed from the reel causing the reel to rotate about the spindle in an unwinding operation. To return the line to a stored position, the rotation of the reel about the spindle is simply reversed, and the line is caused to rewind upon the reel. The rotation of the reel that is necessary to perform the operations of unwinding and rewinding of the line is generally produced manually, although spring actuated return reels for rewinding the line, such as those found in some household appliances, are also common. Typically, these devices can be either stationary or portable. A well-known disadvantage associated with a majority of the spindle-and-reel-type apparatus presents itself when these devices are used for the storage and retrieval of common electrical extension cord. In particular, the devices require that the entire length of electrical cord be unwound from the reel when the cord is in use in order to eliminate temperature increase. Thus, these apparatus become significantly impractical and inefficient in applications where only a short length of the entire electrical extension cord is necessary.

In addition, other methods and devices have been used to eliminate the entanglement that can occur with the repeated storage and retrieval of elongated elements. However, these devices have generally accomplished the task of line storage and retrieval in a conventional manner, similar to that which has been described above, namely, that the line is either forced or required to be wound-up into a coil. Thus, these traditional approaches to line storage and retrieval have consistently employed the necessary step of creating a coil in the line that is to be stored and retrieved.

It is therefore a primary object of the present invention to provide a device which facilitates the storage and retrieval of line and other elongated articles such as cord, rope, hose, wire and the like, that reduces or eliminates undesirable entanglement in the line without forcing or requiring the line to be coiled.

It is an additional object of the present invention to provide a line storage device which is rugged, compact, light-weight and portable. It is a further object of the present Invention to provide a line storage device that is operable to clean and/or dry the line as It is being stored in order to remove dirt, grime and/or moisture which can tend to abrade away the surface of the line or soil or damage floor coverings and the like at the worksite. Another object of the present invention is to provide a line storage device that is capable of protecting the line from dirt and moisture after it has been stored, it is yet another object of the present invention to provide a line storage device that is convenient, practical and efficient to use. It is a still further object of the present invention to provide a line storage device that can be readily and economically manufactured in a high volume production environment utilizing well-known manufacturing methods and techniques.

SUMMARY OF THE INVENTION

Accordingly, the present invention is directed to a rugged, compact light-weight and portable container which facilitates the storage and retrieval of flexible, elongated elements, such as line, cord, rope, hose, wire and the like. According to a first embodiment of the present invention, the line storage device incorporates a base portion which serves to keep the device in a stationary position while in use. From the base portion, there extends a conically-tapered, flexible, body portion that terminates in a closeable aperture. The aperture provides an opening into the interior of the line storage device through which a first end of the line or other elongated element is passed as it is stored or retrieved. The present invention reduces or eliminates entanglement in the line without requiring or causing the line to be coiled.

In operation, storage of a line in the container is accomplished manually. The operator grasps the container with one hand at the section of the body portion just below the aperture and creates a "bottle-neck" at the opening of the container. With his other hand, the operator then linearly feeds the line that is to be stored through the bottle-neck and into the interior of the container, in a manner so as to "stuff" the line into the container. As the line is passed through the bottle-neck, it is effectively wiped clean and dry by the interior surface of the body portion. The cleaning and drying action removes particles of dirt, grime and moisture which can tend to abrade away at the surface of the line or soil the work area that the line is used. The line then proceeds to enter the device and is allowed to fall randomly, subject to the linear feeding action, the force of gravity and the confines of the container. Once the line is stored, the aperture is closed and the line is shielded from dirt and moisture. When a section of the line is needed, the desired length of line is manually withdrawn from the device by the operator, without entanglement.

Line storage and retrieval is accomplished quickly and easily with the assistance of the present invention. In fact, the time required for line storage and retrieval with the present invention is approximately that required for other manually operated line storage apparatus, including spindle-and-reel-type apparatus.

In addition, the line storage device of the present invention can be reducible to a compact configuration for storage purposes by collapsing the flexible body portion and folding it into the base portion. In this position, several of the line storage containers can be stacked upon one another.

Various other embodiments of the line storage device of the present invention are also disclosed. For example, the interior surface of the body portion can be lined with an absorbent material to assist in the wiping action that operates to clean and dry the line as it is stored. Also, a hand receptacle can be included in the device that provides a means by which the operator can easily create the "bottle-neck" through which the line is passed as it is being stored. Further, the base portion can incorporate a small aperture to provide access to a second end of the line that is stored. Still further, the base portion and/or body portion can include a plurality of holes for facilitating airflow through the container or permitting the drainage of moisture from the container.

BRIEF DESCRIPTION OF THE DRAWINGS

The various features and advantages of the present invention will become apparent to one skilled in the art upon reading the following specification, in which:

FIG. 1 is a pictorial view illustrating a line storage device constructed according to the principles of the present invention;

FIG. 2 is a pictorial view showing a line storage device constructed according to the principles of an alternate embodiment of the present invention;

FIG. 3 is a view showing a hand receptacle for use with the line storage device of FIG. 1;

FIG. 4 is a pictorial view illustrating the aperture and partial interior of a body portion of a line storage device constructed according to the principles of the present invention;

FIG. 5 is a detail view showing the aperture within the base portion of a line storage device constructed according to the principles of the present invention;

FIG. 6 is a pictorial view featuring several line storage devices of the present invention, such as those that are depicted in FIGS. 1 and 2, being shown in a variety of different sizes and being stacked upon one another in a storage position;

DESCRIPTION OF THE PREFERRED EMBODIMENT

Figure 7:
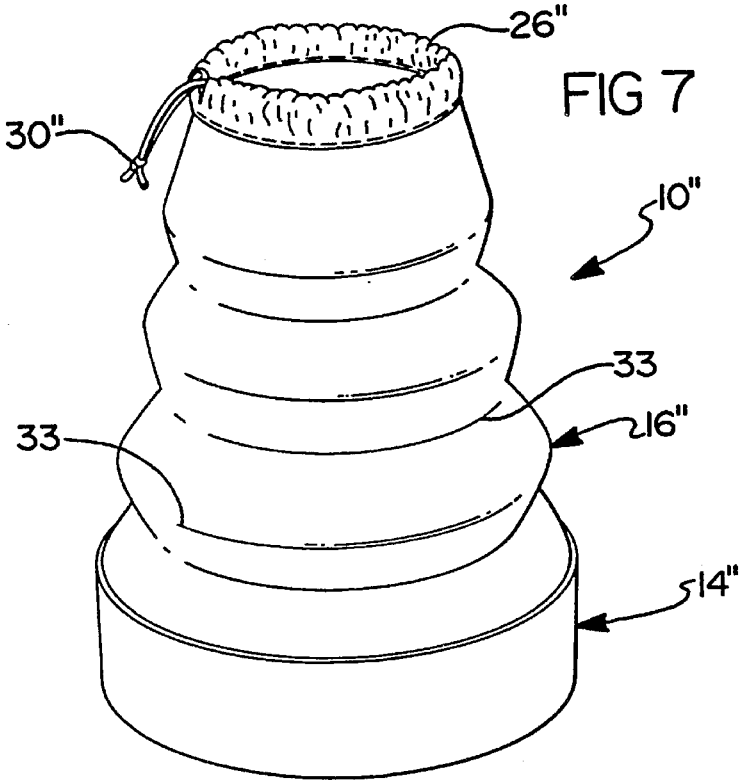
FIG. 7 is a pictorial view illustrating a line storage device constructed according to the principles of yet another alternate embodiment of the present invention.

It should be understood from the outset that while the drawings and following discussion relate to particular embodiments of the present invention, these embodiments merely represent what is presently regarded as the best mode of practicing the invention and other modifications may be made to the particular embodiments without departing from the spirit and scope of the invention.

Referring now to the drawings, one embodiment of a line storage device 10 for the storage and retrieval of flexible, elongated elements 12 such as line, cord, rope, hose, wire and the like of the present invention is shown in FIG. 1. This embodiment of the device 10 is generally a bag-like container including a base portion 14 and a body portion 16. The base portion 14 is shown to be cylindrical in shape having a bottom wall 18 and a side wall 20. The base portion 14 is intended to be heavy and sturdy enough to support the device 10 in a stationary position while in use. To this end, the base portion 14 can be weighted, such as with sand or another suitable material, or alternately can incorporate a wall thickness that is sufficient to provide the desired weight and toughness characteristics.

Extending from the base portion 14 is a body portion 16 which is shown to be conically-tapered. The body portion 16 incorporates a flexible, thin-walled structure having an exterior surface 22 and an interior surface 24. The body portion 16 terminates in an aperture 26 that is located opposite the base portion 14. The aperture 26 provides an opening into the interior of the container 10 through which a first end 28 of the line or other elongated element 12 is passed as it is stored or retrieved. A drawstring mechanism 30 is shown to be incorporated in the body portion 16 to provide means to close and open the aperture 26, however, other suitable means can also be employed.

In operation, storage of a line 12 in the device 10 is accomplished manually. First, the operator grasps the device 10 with one hand at a section of the body portion 16 just below the aperture 26 and creates a "bottle-neck" at the opening of the device 10. With his other hand, the operator then linearly feeds the line 12 that is to be stored through the bottle-neck and into the interior of the device 10, in a manner so as to "stuff" the line 12 into the device 10. As the line 12 is passed through the bottle-neck, it is effectively wiped clean and dry by the interior surface 24 of the body portion 16. The line 12 then continues to enter the device 10 and is allowed to fall randomly, subject to the forces of gravity and the confines of the device 10, as depicted in FIG. 1. Once the line 12 is stored, the aperture 26 can be closed by the drawstring mechanism 30 to shield the line 12 from dirt and/or moisture. A section of the line 12 can subsequently be withdrawn by the operator, as needed, without entanglement. The time required to operate the present invention is comparable to that of other manually-operated line storage devices.

It should be appreciated that the linear-feed method of storage utilized with the present invention provides unique advantages not found in conventional line storage devices which require or initiate coiling of the line. Among others, one advantage is that through repeated use, any "kinks" or other undesirable characteristics in the line that tend to cause entanglements are significantly reduced or eliminated by the storage process which effectively "straightens" the line and smooths out the "kinks" as the line is stored. Also, the present invention overcomes the disadvantage described earlier with respect to the storage by coiling of electrical extension cord. In particular, the entire length of electrical cord does not have to be removed from the device in order to maintain the maximum amperage capacity of the cord because the present invention allows the line to be stored in a random fashion, rather than by coiling.

As best seen in FIGS. 5 and 6, the base portion 14 of the line storage device 10 can include an aperture 40 to accommodate access to a second end 42 of the line 12 that is stored. FIG. 5 shows that the aperture 40 has both a large opening 44 and a small opening 46 which are separated by two flexible, finger-like tabs 48. The aperture 40 acts in combination with clips 50 that are positioned on an exterior surface 52 of the side wall 20 of the base portion. The aperture 40 illustrated in FIG. 5 is especially helpful when using the present invention for the storage of electrical extension cord 12. For example, the large opening 44 is sufficient to allow an electrical receptacle 54 to pass through, and the small opening 46 is sized to accommodate the diameter of the electrical cord 12 itself. The receptacle 54 is first passed through the large opening 44 and then the cord 12 is forced past the tabs 48 and into the small opening 46. Once in this configuration, a small length of cord 12 can be withdrawn from the container 10 and secured in the clips 50 on the side wall 20 of the base portion 14, which is best seen in FIGS. 1 and 6. The second end 42 of the cord 12 is then prevented from being pushed or pulled back through the aperture 40 and into the container 10. Consequently, both ends 28, 42 of the cord 12 are accessible for use.

As shown in FIG. 6, the line storage device of the present invention 10 is reducible to a compact configuration for storage purposes. This is achieved by collapsing the flexible body portion 16 and folding it over and into the base portion 14. In this position, several of the line storage devices 10 can be stacked upon one another, as illustrated.

An alternate embodiment 10' of the present invention is shown in FIG. 2. In this embodiment, the base portion 14' includes a plurality of holes 32 in the bottom and side walls 18' and 20', respectively, and the body portion 16' is formed in a mesh-like pattern. This configuration is especially useful to improve airflow through the container 10' for dissipating heat from the stored line (not shown). Also, improved airflow through the device 10' enhances the ability of the stored line (not shown) to dry, which is an Important consideration when storing boat line, for example.

In still another embodiment of the present invention, illustrated in FIG. 7, the line storage device 10" provides that the body portion 16" can be formed with pleats or creases 33 so as to allow the body portion 16" to be collapsed in an accordion-like fashion. In this manner, the body portion 16" is easily and repeatably collapsible to a predetermined compact configuration. Also, in this embodiment, the body portion 16" can incorporate a wall thickness that imparts greater weight, rigidity and strength to the line storage device 10", yet due to the pleats 33 the body portion 16" remains collapsible to a compact configuration.

Turning once again to FIG. 1, and in addition, FIGS. 2 and 3, a "mitten-like" hand receptacle 34 is shown to be included in the line storage device 10, 10' of the present invention. The hand receptacle 34 is located on the exterior surface 22, 22' of the body portion 16, 16' near the aperture 26, 26'. The hand receptacle 34 provides an independent means by which the operator can easily create the bottle-neck through which the line 12 is passed as it is stored. For example, with the hand receptacle 34, the operator first inserts his hand into the hand receptacle 34 and then grasps the line 12, through the flexible body portion 16, 16', to create the bottle-neck. However, it should be understood that inclusion of the hand receptacle 34 in the device is not required to facilitate line storage and retrieval as already described. Rather, it simplifies the task of the operator when using the device. For example, use of the hand receptacle 34 gives the operator greater control over the process of feeding the line into the storage device 10, 10'. Also, the hand receptacle 34 provides a convenient and secure means to hold the device 10, 10' while in use.

As illustrated in FIG. 2, a single hand receptacle 34, can be incorporated in the device 10'. However, as shown in FIG. 1, two separate hand receptacles 34' can be included, one for the right hand 34'R and one for the left hand 34'L to facilitate the ease of operation for both right and left-handed operators. To this same end, FIG. 3 illustrates a single hand receptacle 34" which can be used by the operator with either his right or left hand.

Figure 8:
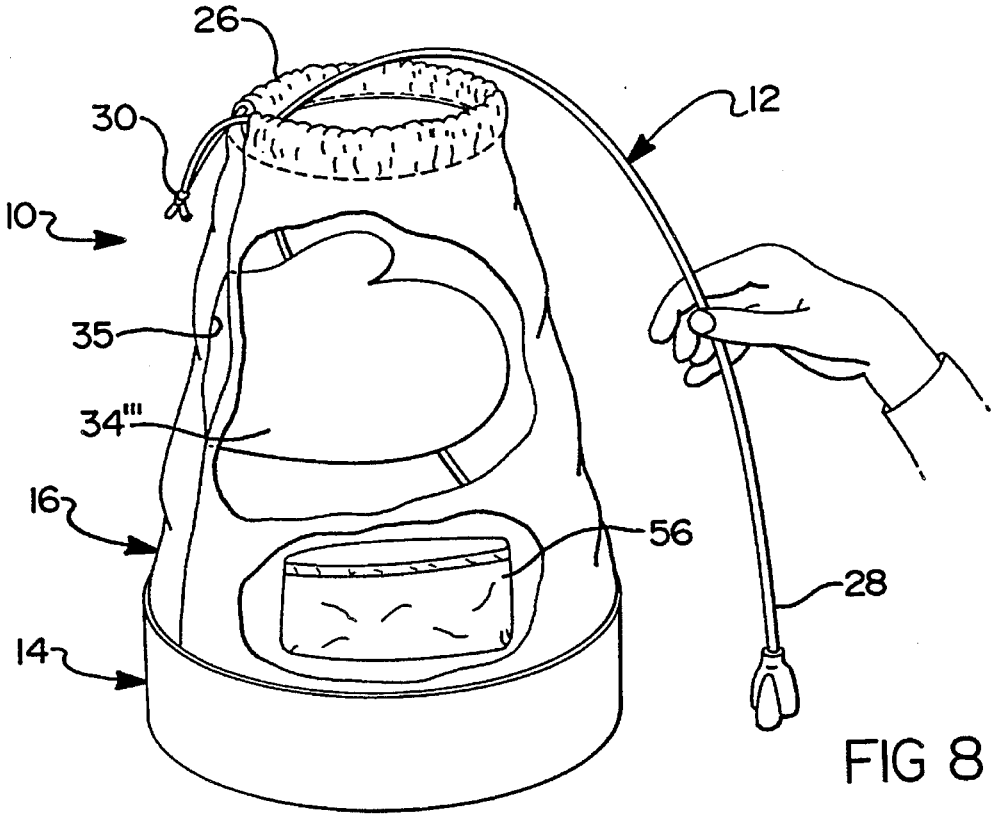
FIG. 8 is a pictorial view including a broken-out section showing an alternate embodiment of a hand receptacle for use with the line storage device of the present invention.

Alternatively, a hand receptacle 34'" can be incorporated within the interior of the line storage device 10, as shown in FIG. 8. In this embodiment, access to the hand receptacle 34'" is provided by an aperture 35 through the side of the body portion 16. In use, the operator simply inserts his hand through the aperture 35 and into the hand receptacle 34'" to enable him to then grasp the line and create a bottleneck.

With reference to FIG. 4, the aperture 26 of the body portion 16 of a line storage device 10 is shown in enlarged detail. An absorbent wiping material 38 is illustrated as being included on the interior surface 24 of the body portion 16 for enhancing the cleaning and drying action that occurs as the line 12 is passed through the bottle-neck in the body portion 16 as it is stored. The wiping material 38 can be removably attached to the interior surface 24 of the body portion 16, such as by Velcro®, a hook and loop fastening means, to allow it to be easily cleaned and/or replaced. Further, the wiping material 38 can be incorporated together with the hand receptacles 34, 34' 34" and 34'". For example, with the hand receptacle 34'", the wiping material 38 can be included on the hand receptacle 34'" itself. A strong and absorbent material, such as a cotton fabric, is suitable to be used as the wiping material 38.

The line storage device 10 of the present invention is intended to be light-weight and portable, yet be rugged enough to withstand the rigors of frequent use under a variety of working conditions. To this end, the line storage device 10, including both the base portion 14 and the body portion 16, can be manufactured from a suitably tough material such as canvas, nylon, polyester, plasticized PVC, a TPO polyolefin or any other similar natural or synthetic fiber or fabric. Further, the process of manufacture of the present invention is readily incorporated into a low cost, high volume production environment.

It is further contemplated that the line storage device 10 of the present invention could be manufactured in a variety of different sizes to accommodate, for example, various types, lengths, diameters, gauges, etc. of line 12 that is desired to be stored therein. Also, external markings or other indicia, such as color coding of the device 10, may be used to identify the different types, lengths, diameters, gauges, etc. of stored line 12.

It should also be appreciated that other objects, in addition to line, can be stored within the interior of the line storage device of the present invention. For example, small tools, work gloves, or other items which can fit through the aperture of the device can be stored in the device by the operator. Alternatively, the line storage device 10 of the present invention can include one or more pockets or pouches 56 shown at FIG. 8 that are either attached to or integrally formed within either or both the exterior surface 22 or interior surface 24 of the body portion 16. The pouches can then be used for additional storage space.

The present invention has been described in an illustrative manner. It should be understood that the terminology which has been used is Intended to be in the nature of words of description rather than of limitation. Many modifications or variations to the present invention are possible in light of the above teachings. Therefore, within the scope of the following claims, the present invention may be practiced otherwise than as specifically described.

What is claimed is:

1. A line storage device comprising:

a base portion;

a body portion extending from said base portion and terminating at a first aperture, said body portion having an interior surface and an exterior surface, said base portion and said body portion operatively defining an interior of said device;

at least one hand receptacle, said hand receptacle being located on said exterior surface of said body portion;

wiping means comprising an absorbent material, said wiping means being located on said interior surface of said body portion adjacent to said hand receptacle; and a second aperture in said base portion, said second aperture including a first opening and a second opening, said first opening being at least partially separated from said second opening, said first opening being larger than said second opening.

2. The device of claim 1 wherein said hand receptacle comprises means to receive either a left or right hand.

3. The device of claim 1 further comprising fastening means for removably attaching said wiping means to said interior surface of said body portion.

4. The device of claim 1 further comprising means for opening and closing said first aperture.

5. The device of claim 1 further comprising at least one pouch located on said body portion.

6. The device of claim 1 further comprising means for collapsing said body portion.

7. The device of claim 6 wherein said means for collapsing said body portion comprises pleats.

8. A line storage device comprising:

a base portion;

a body portion extending from said base portion and terminating at a first aperture, said body portion having an interior surface and an exterior surface, said base portion and said body portion operatively defining an interior of said device;

at least one mitten-shaped hand receptacle, said hand receptacle being attached to said exterior surface of said body portion near said first aperture; and wiping means located on said interior surface of said portion adjacent to said hand receptable, said wiping means comprising an absorbent material.

9. The device of claim 8 wherein said hand receptacle comprises means to receive either a left or right hand.

10. The device of claim 8 further comprising fastening means for removably attaching said wiping means to said interior surface of said body portion.

11. The device of claim 8 further comprising at least one pouch located on said body portion.

12. A line storage device in combination with a line comprising:

a flexible, elongated line having a first end and a second end; and a storage device, comprising:

a base portion;

a flexible body portion extending from said base portion and terminating at a first aperture, said body portion having an interior surface and an exterior surface, said base portion and said body portion operatively defining an interior of said device for storage of said flexible, elongated line; and at least one mitten-shaped hand receptacle, said hand receptacle including an interior for receiving a hand of a user, the interior being defined by an adjacent section of said flexible body portion and a layer of material attached about its perimeter directly to said exterior surface of said body portion near said first aperture, said adjacent section of said flexible body portion including a first side disposed within said flexible body portion, said first side operative to cooperate with a hand placed in said hand receptacle to grasp said flexible, elongated line.

13. The combination of claim 12 wherein said interior of said mitten-shaped hand receptacle includes a first area for receiving a thumb of said hand and a second area for receiving a plurality of fingers of said hand, said first and second areas being spaced apart and distinctly defined.

14. The combination of claim 12 further comprising wiping means located on said interior surface of said body portion adjacent to said hand receptacle, said wiping means comprising an absorbent material.

15. The combination of claim 14 further comprising fastening means for removably attaching said wiping means to said interior surface of said body portion.

16. The combination of claim 12 further comprising at least one pouch located on said body portion.

* * * * *